United States Patent [19]

Kamp et al.

[11] Patent Number: 4,767,072

[45] Date of Patent: Aug. 30, 1988

[54] ENDLESS YARN TRAVERSING BAND FOR A YARN TRAVERSING DEVICE IN A MACHINE FOR PRODUCING CROSS-WOUND BOBBINS

[75] Inventors: Heinz Kamp, Wegberg; Rolf Becker, Monchengladbach, both of Fed. Rep. of Germany

[73] Assignee: W. Schlafhorst & Co., Fed. Rep. of Germany

[21] Appl. No.: 84,690

[22] Filed: Aug. 12, 1987

[30] Foreign Application Priority Data

Aug. 13, 1986 [DE] Fed. Rep. of Germany ..... 3627516

[51] Int. Cl.[4] ..... B65H 54/28

[52] U.S. Cl. ..... 242/43 A; 242/158 B

[58] Field of Search ..... 242/43 R, 43 A, 158 B

[56] References Cited

U.S. PATENT DOCUMENTS

| | | | |
|---|---|---|---|
| 2,238,128 | 4/1941 | Nydegger | 242/43 A |
| 3,029,649 | 4/1962 | Steyh | 242/158 B X |
| 3,333,782 | 8/1967 | Beckwith, Jr. | 242/43 A |
| 3,491,962 | 1/1970 | Roberts | 242/43 A |
| 3,586,251 | 6/1971 | Burdge | 242/43 A |
| 3,620,464 | 11/1971 | Ueda et al. | 242/43 A |
| 4,674,695 | 6/1987 | Kamp et al. | 242/43 A |

FOREIGN PATENT DOCUMENTS

| | | |
|---|---|---|
| 1710077 | 3/1971 | Fed. Rep. of Germany . |
| 1422593 | 11/1965 | France . |
| 447901 | 3/1968 | Switzerland . |

*Primary Examiner*—Stanley N. Gilreath

*Attorney, Agent, or Firm*—Shefte, Pinckney & Sawyer

[57] ABSTRACT

An endless yarn traversing band for a yarn traversing device in a machine for producing cross-wound bobbins. The band has spaced yarn guiding projections in a sawtoothed configuration. The band is formed of a textile yarn or metallic yarn fabric embedded in an elastomeric material. C-shaped sheaths of stainless steel are clamped over the leading edges of the yarn guiding projections. These leading edges project generally perpendicularly from the band up to a maximum inclination away from the direction of travel of the band of approximately 10 degrees. The trailing edges of the yarn guiding projections are convexly shaped such as with an outer extent angled approximately 10 degrees inwardly from the outer end of the leading edge and an inward extent extending at a greater inclination. The band is produced by forming layers of fabric, embedding the fabric in an elastomeric material, cutting the embedded fabric to the shape of the band and yarn guiding projections, scarfing and joining the ends of the band to form an endless band and then clamping the sheaths on the leading edges of the yarn guiding projections. Alternatively, the yarn guiding projections can be inserted between the fabric layers before embedding in the elastomeric material, also, alternatively, the fabric can be wound in endless layers and embedding in elastomeric material in endless form.

13 Claims, 2 Drawing Sheets

ENDLESS YARN TRAVERSING BAND FOR A YARN TRAVERSING DEVICE IN A MACHINE FOR PRODUCING CROSS-WOUND BOBBINS

BACKGROUND OF THE INVENTION

The present invention relates to an endless yarn traversing band for a yarn traversing device in a machine for producing cross-wound bobbins, which band is provided with spaced yarn guiding means projecting from an edge of the band in a sawtoothed configuration, and also relates to a method of production of such an endless yarn traversing band.

SUMMARY OF THE INVENTION

The present invention provides an improved yarn traversing band that is especially adapted for enhanced yarn traversing operation, that can be easily manufactured, that is subject to little wear, and can be operated simply and economically. Further, the invention provides a method whereby a band can be readily manufactured.

Briefly described, the endless yarn traversing band of the present invention has fabric embedded in an elastomeric material and has guiding means formed with leading edges covered by wear-resistant reinforcing means. With this construction an endless traversing band is formed that is both strong and flexible, being capable of withstanding the flexure and wear of traveling around guide and drive rollers during operation, and yet has a wear-resistant surface on the leading edges of the guide means to withstand the wear from the traveling yarn that is being traversed by the guiding means.

Preferably, the fabric is formed of either textile yarns or metallic yarns and the reinforcing means are sheaths of wear-resistant material.

The leading edges of the guiding means may project generally perpendicularly from the band. Preferably, the leading edges project at an inclination away from the direction of travel of the band a maximum of approximately 10 degrees so that they maintain engagement with the yarn during traversing yet allow the yarn to slide from the leading edges at the end of each traverse.

To provide strength and stability, the trailing edges of the guiding means are convexly shaped, preferably being angled convexly, and in the preferred embodiment the trailing edges have outer extents inclined from the outer ends of the leading edges at approximately 10 degrees inwardly and inward extents extending from the outer extents at an inward inclination greater than the inclination of the outer extents. This construction also avoids undesirable yarn engagement by the trailing edges.

In the preferred embodiment the locations of transition from the band to the yarn engaging means are rounded to minimize fatigue failure and assure long service life by the elimination of sharp corners or notches.

Preferably, the sheaths are slotted and inherently resilient for removable clamping on the guiding means over the leading edges. In the preferred embodiment the sheaths are generally C-shaped in cross-section and are made of stainless steel. This construction is simple, economical and long-lasting. Further, it has no appreciable adverse effect on the flexibility of the yarn traversing band otherwise, especially with the longitudinal slot and C-shaped cross-section that result in only line contact with the guiding means. Such sheaths are conventional in other uses as adaptor sleeves or split pins, such that these components are advantageously readily available.

Briefly described, the method of the present invention involves embedding a fabric in elastomeric material, cutting the embedding fabric to form the band with projecting guiding means, and applying wear-resistant reinforcing means over the leading edges of the guiding means. Preferably, a plurality of layers of fabric are embedding in the elastomeric material, and the fabric is either made of textile yarns or metallic yarns.

Alternatively, the method is performed by placing a plurality of fabric layers together, inserting yarn guiding means of fabric between the layers to project therefrom, embedding the fabric layers and fabric yarn guiding means in elastomeric material, and applying wear-resistant reinforcing means over the leading edges of the guiding means.

Preferably, the endless band is completed by scarfing the ends of a band of embedding fabric, overlapping the scarfed ends, and securing the ends together to form the endless band.

In one form of the method of the present invention, the fabric is wound on a cord to provide several layers of fabric prior to embedding in the elastomeric material, resulting in an endless band without having to join two ends together.

Further features and advantages of the present invention will be apparent from the accompanying drawings and following detailed description of the preferred embodiments.

DETAILED DESCRIPTION OF THE PREFERRED EMBODIMENTS

Figure 1:
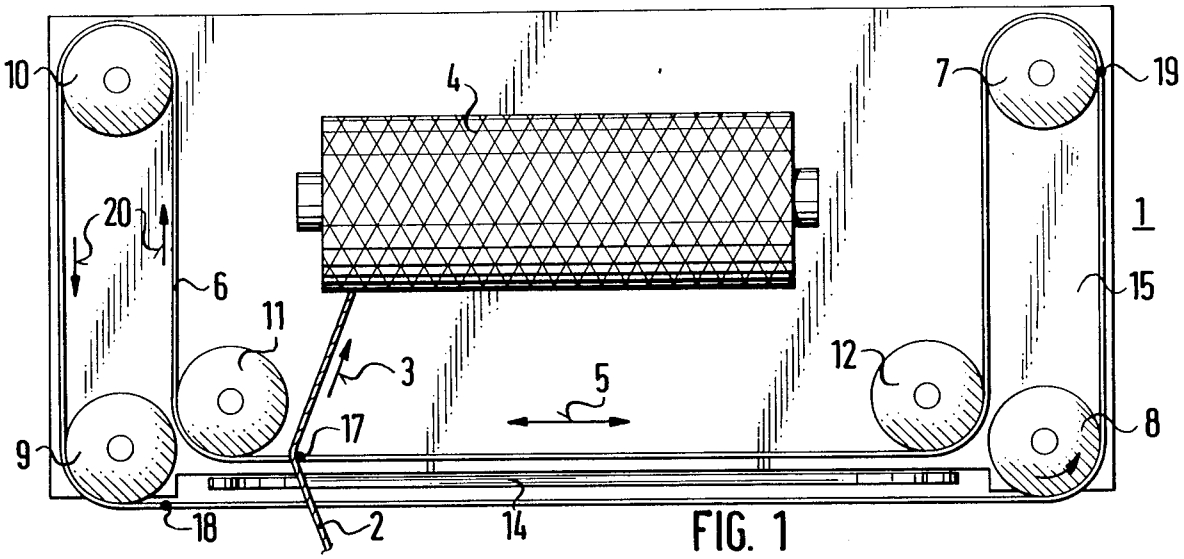
FIG. 1 is a plan view of a yarn traversing device in which an endless yarn traversing band according to the present invention is incorporated.
Figure 2:
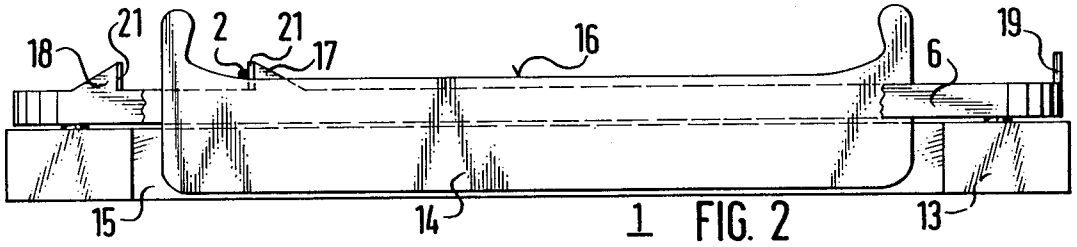
FIG. 2 is a front elevation of the yarn traversing device of FIG. 1.

The endless yarn traversing band 6 of the preferred embodiment of the present invention is illustrated in FIGS. 1 and 2 incorporated in a conventional yarn traversing device 1 of a machine that produces cross-wound bobbins. This traversing device 1 feeds yarn 2 in the direction of arrow 3 to a rotating cross-wound bobbin 4 and winds it in crossed layers. To accomplish this, the yarn traversing device 1 continually traverses the yarn 2 in the direction of the double arrow 5. For this purpose, the endless yarn traversing band 6 of the present invention travels around rollers 7 to 12, of which one roller 8 is a drive roller and the other rollers are guide rollers. All six of these rollers are mounted on a carrier body 15 that also carries a yarn guide plate 14 having a contour 16 rising at its ends, as can be seen in FIG. 2.

The yarn traversing band 6 has three spaced yarn engaging means 17, 18 and 19 projecting from one edge of the band in a sawtoothed shape. The leading edges of the yarn engaging means 17, 18 and 19, which are leading in the direction of travel 20 of the yarn traversing band 6, are each covered by a wear-resistant reinforcing means 21.

As seen in FIG. 2, one of the yarn guiding means 17 is traveling to the left and guides the yarn 2, with the yarn sliding on the yarn guide contour 16 of the yarn guide plate 14. As the yarn guiding means 17 approaches the end of the yarn guide plate 14, the yarn rides upwardly on the contour to a position above the top of the yarn engaging means 17, from which it is thereby released and slides back downwardly due to tension. It is immediately engaged by the second yarn engaging means 18 that travels from left to right in FIG. 2, with the yarn subsequently traversing to the right until it again rides up the surface of the yarn guide contour 16 off the upper end of the yarn guiding means 18 and is subsequently engaged by the third yarn engaging means 19, which traverses the yarn from right to left. This traversing action continues until the bobbin is completely wound and the machine is stopped. In FIG. 1 the yarn engaging means 17, 18 and 19 are illustrated only by dots for the sake of clarity of illustration.

As seen in FIG. 2, the yarn guiding means 17, 18 and 19 are in the form of projections having their leading edges extending generally perpendicularly from the band 6, with the trailing edge extending at an inclination from the outer end of the leading edge to the band 6.

Figure 3:
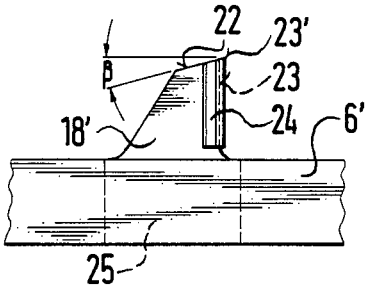
FIG. 3 is an enlarged elevation of an alternate form of yarn guiding means and adjacent portions of the yarn traversing band of the present invention.
Figure 4:
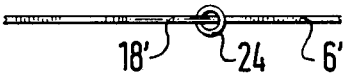
FIG. 4 is a plan view of the yarn guiding means and adjacent yarn traversing band portions of FIG. 3.
Figure 5:
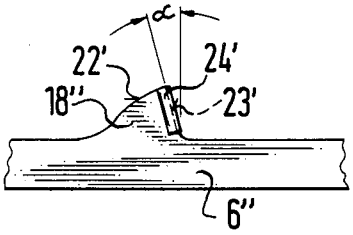
FIG. 5 is an elevation similar to FIG. 3, showing another alternate form of the yarn guiding means of the yarn traversing band of the present invention.

In the alternative design of a yarn traversing band 6' of FIGS. 3 and 4, the trailing edge 22 is convexly shaped, and is seen to be angled convexly with an outer extent inclined from the outer end 23' of the leading edge 23 at an angle of approximately 10 degrees inwardly, indicated by the angle beta in FIG. 3, and an inner extent extends from the outer extent at an inward inclination greater than the inclination of the outer extent. FIG. 5 illustrates another alternative design in which the trailing edge 22' extends smoothly convexly from the outer end of the leading edge 23' which, as indicated by the angle alpha in FIG. 5, is sufficiently close to perpendicular to maintain yarn guiding engagement during traversing and yet has a slight inclination, preferably 10°, away from the direction of band travel to facilitate sliding of the yarn from the surface of the leading edge 23' as the yarn is raised by the ends of the contoured surface 16 of the guide plate 14 at the ends of traverse. These convex constructions provide enhanced strength and stability with the inward inclination serving to minimize the possibility of yarn engagement by the trailing edges.

As seen in FIG. 3, the locations of transition from the band 6' to the yarn guiding projection 18' are rounded for strengthening.

Mounted in covering relation over the leading edges 23 of the yarn guiding projections 17, 18 and 19 are wear-resistant reinforcing means in the form of sheaths 21, 24 and 24'. These sheaths are slotted and inherently resilient by being generally C-shaped in cross-section. With this construction, the sheaths 21, 24 and 24' can be clamped in line contact so that they do not interfere with the flexibility of the band 6 and yet they provide the wear-resistance to the traveling yarn 2 that not only travels transversely to the sheaths but also rides up and down at the ends of traverse. The sheaths 21, 24 and 24' are made of stainless steel for strength and protection against corrosion.

The yarn traversing bands 6 and 6'' of FIGS. 2 and 5 are produced by embedding a fabric in an elastomeric material, with the fabric being formed of textile yarn or metallic yarn. The fabric is first wound in a plurality of layers that are passed through a conventional rubberizing bath to embed the fabric in elastomeric material to provide a flexible band that has little expansion in the direction of travel in the traversing device. This initial band is then divided into several bands by cutting, such as in a conventional stamping operation, that forms the bands with the yarn guiding projections 18 and 18'' described above. The bands are then scarfed at both of their ends in a conventional manner and the ends are then overlapped and joined in a rubberizing operation to form the endless band. Following this the reinforcing sheaths 21 and 24' are clamped onto the yarn guiding projections over the leading edges thereof.

In an alternative method, the yarn traversing band 6' of FIGS. 3 and 4 is produced by winding a fabric of textile yarns around a core or drum that has a circumference equivalent to the length of the finished endless band. Four layers of fabric are wound in this manner and the bases 25 of yarn guiding projections 18' are inserted between the layers. In this arrangement the yarn guiding projections are formed of flexible material, such as textile fabric. The band, with the inserted yarn guiding projections 18' is then rubberized by embedding in an elastomeric material. Finally, the sheaths 24 are clamped on the leading edges 23 of the yarn guiding projections 18'.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. An endless yarn traversing band for a yarn traversing device in a machine for producing cross-wound bobbins, which band is provided with spaced yarn guiding means projecting from an edge of the band in a sawtoothed configuration, said yarn traversing band comprising fabric embedded in an elastomeric material and having said guiding means formed with leading edges covered by wear-resistant reinforcing means.

2. An endless yarn traversing band according to claim 1 and characterized further in that said fabric is formed of textile yarns.

3. An endless yarn traversing band according to claim 1 and characterized further in that said fabric is formed of metallic yarns.

4. An endless yarn traversing band according to claim 1 and characterized further in that said reinforcing means are sheaths of wear-resistant material.

5. An endless yarn traversing band according to claim 1 and characterized further in that said leading edges project generally perpendicularly from said band.

6. An endless yarn traversing band according to claim 1 and characterized further in that said leading edges project from said band at an inclination away from the direction of travel of said band a maximum of approximately 10 degrees.

7. An endless yarn traversing band according to claim 1 and characterized further in that said guiding means have trailing edges that are convexly shaped.

8. An endless yarn traversing band according to claim 7 and characterized further in that said trailing edges are angled convexly.

9. An endless yarn traversing band according to claim 8 and characterized further in that said trailing edges have outer extents inclined from the outer ends of said leading edges at approximately 10 degrees inwardly and inner extents extending from said outer extents at an inward inclination greater than the inclination of said outer extents.

10. An endless yarn traversing band according to claim 1 and characterized further in that the locations of transition from said band to said yarn guiding means are rounded.

11. An endless yarn traversing band according to claim 4 and characterized further in that said sheaths are slotted and inherently resilient for removable clamping on said guiding means over said leading edges.

12. An endless yarn traversing band according to claim 11 and characterized further in that said sheaths are generally C-shaped in cross-section.

13. An endless yarn traversing band according to claim 11 and characterized further in that said sheaths are made of stainless steel.

* * * * *